US011095050B2

(12) United States Patent
Huang et al.

(10) Patent No.: US 11,095,050 B2
(45) Date of Patent: Aug. 17, 2021

(54) CABLE CONNECTOR

(71) Applicant: Tarng Yu Enterprise co., ltd., New Taipei (TW)

(72) Inventors: Mu-Jung Huang, New Taipei (TW); Ying-Chung Chen, New Taipei (TW); Po-Shen Chen, New Taipei (TW)

(73) Assignee: TARNG YU ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/672,238

(22) Filed: Nov. 1, 2019

(65) Prior Publication Data

US 2020/0144734 A1 May 7, 2020

(30) Foreign Application Priority Data

Nov. 5, 2018 (TW) ..... 107139138

(51) Int. Cl.
*H01R 4/2433* (2018.01)
*H01R 4/2454* (2018.01)

(52) U.S. Cl.
CPC ..... *H01R 4/2433* (2013.01); *H01R 4/2454* (2013.01)

(58) Field of Classification Search
CPC .... H01R 4/2445; H01R 4/2433; H01R 4/245; H01R 4/2452; H01R 4/2454; H01R 4/2456
USPC ..... 439/399, 400, 401
See application file for complete search history.

(56) References Cited

U.S. PATENT DOCUMENTS 3,950,065 A * 4/1976 Renn ..... H01R 4/2462 439/398
4,046,446 A * 9/1977 Reavis, Jr. ..... H01R 4/2462 439/401
4,220,390 A * 9/1980 Cobaugh ..... H01R 4/2462 439/401
4,834,670 A * 5/1989 Rodondi ..... H01R 4/2462 439/398
5,030,132 A * 7/1991 Hayes ..... H01R 4/245 439/397
5,669,778 A * 9/1997 Kramer ..... H01R 4/2445 439/398
9,397,412 B2 * 7/2016 Schmidt ..... H01R 4/2433
9,543,665 B2 * 1/2017 Sabo ..... H01R 4/2433

* cited by examiner

*Primary Examiner* — Renee S Luebke
*Assistant Examiner* — Paul D Baillargeon
(74) *Attorney, Agent, or Firm* — Chun-Ming Shih; Lanway IPR Services

(57) ABSTRACT

A cable connector includes a conductive terminal having a positioning wall and a piercing wall. The piercing wall can pierce an outer insulating sheath of a thin cable to be electrically connected to an inner core of the cable. The positioning wall can position the thin cable to reduce bending or dislocation of the thin cable caused by a force and thus minimize pulling of the core. This ensures electrical connection between the piercing wall and the core of the thin cable, and also prevents the core from being damaged or broken by any pulling force.

14 Claims, 22 Drawing Sheets

12

CABLE CONNECTOR

CROSS-REFERENCE TO RELATED APPLICATIONS

This application claims the priority of Taiwan Application No. 107139138 filed on Nov. 5, 2018, in the State Intellectual Property Office of the R.O.C., the disclosure of which is incorporated herein by reference.

BACKGROUND OF THE INVENTION

Field of the Invention

The present invention relates to connectors, and more particularly, to a cable connector for forming electrical connection with cables.

Descriptions of the Related Art

Technological innovations of wearable devices integrate electronic elements and information transmission techniques with wearable smart clothes, which have been massively developed. To be user friendly, the electronic elements preferably use thin cables in order to be well accommodated in the wearable smart clothes. In such a case, how to form proper electrical connection for the cables of the electronic elements must be considered. If there is no effective electrical connection for the cables of the electronic elements, the electronic elements cannot work as desired and the smart clothes would fail in function.

Therefore, how to provide a connector that can effectively form electrical connection for thin cables is an important task to be solved in the art.

SUMMARY OF THE INVENTION

In view of the above drawback in the prior art, the present invention is to provide a cable connector for forming electrical connection with a cable, the cable including a core and an outer insulating sheath covering the core, the cable connector including: an insulation base having an embedding opening; and at least one conductive terminal embedded in the insulation base through the embedding opening, the at least one conductive terminal including a terminal body, a piercing wall and a positioning wall, the piercing wall including a piercing guiding portion and a piercing blade portion, the positioning wall including a positioning guiding portion and a positioning hole, wherein the positioning wall and the piercing wall are extended from a side of the terminal body to make the piercing guiding portion and the positioning guiding portion open towards a predetermined direction, so as to allow the cable to move in the predetermined direction and reach the piercing guiding portion and the positioning guiding portion where the cable is guided by the piercing guiding portion and the positioning guiding portion to enter the piercing blade portion and the positioning hole, wherein the outer insulating sheath is pierced by the piercing blade portion and the core is electrically connected to the piercing blade portion, and the cable is accommodated in and positioned by the positioning hole.

Preferably, the cable connector said above, wherein the embedding opening is provided on a top or bottom side of the insulation base, allowing the at least one conductive terminal to be embedded in the insulation base from the top or bottom side of the insulation base through the embedding opening, and the terminal body is coupled to shorter or longer sides of both the positioning wall and piercing wall.

Preferably, the cable connector said above, wherein the terminal body is positioned on a side of the insulation base away from the embedding opening.

Preferably, the cable connector said above, further including at least one coupling wall, and wherein the at least one conductive terminal includes two conductive terminals forming a single unit by the coupling wall that is coupled to the piercing walls of the two conductive terminals.

Preferably, the cable connector said above, further including a plurality of coupling walls, and wherein the at least one conductive terminal includes a plurality of conductive terminals, and each of the coupling walls is coupled to two of the plurality of conductive terminals, so as to form a plurality of single units from the plurality of coupling walls and their corresponding coupled conductive terminals, wherein the plurality of single units are aligned in rows and embedded in the insulation base at intervals.

Preferably, the cable connector said above, wherein the coupling wall is coupled to longer sides of the piercing walls.

Preferably, the cable connector said above, wherein a bottom side of the terminal body is formed a bonding portion that is exposed from the bottom side of the insulation base, and is used for bonding a carrier so as to achieve electrical connection with the carrier.

Preferably, the cable connector said above, wherein the positioning wall is extended in a direction away from the piercing wall to form a bonding portion exposed from the insulation base, wherein the bonding portion is for being bonded to a carrier to form electrical connection between the cable connector and the carrier.

Preferably, the cable connector said above, wherein the piercing wall and the positioning wall respectively have a U-shape cross section.

Preferably, the cable connector said above, wherein the at least one conductive terminal includes a plurality of conductive terminals that are aligned in rows and embedded in the insulation base at intervals.

Preferably, the cable connector said above, wherein the positioning wall and the piercing wall are substantially parallel to each other, and the piercing blade portion faces directly the positioning hole.

Preferably, the cable connector said above, wherein the piercing wall has a left-right symmetrical structure, allowing the piercing guiding portion to guide the cable to enter the piercing blade portion in a middle position, and making both left and right sides of the piercing blade portion electrically connected to the core.

Preferably, the cable connector said above, wherein when the cable is entering the positioning hole, the cable touches the positioning guiding portion, making the positioning wall have a first shape to guide the cable to enter the positioning hole, and after the cable enters the positioning hole, the cable leaves the positioning guiding portion, making the positioning wall have a second shape to position the cable within the positioning hole.

Preferably, the cable connector said above, wherein the piercing wall further includes an engaging portion that is used to engage the insulation base after the conductive terminal is embedded in the insulation base and thus to keep the conductive terminal in position.

In comparison to prior arts, a primary object of the present invention is to provide a cable connector. The cable connector includes a conductive terminal having a piercing wall. The piercing wall can pierce an outer insulating sheath of a thin cable to be electrically connected to an inner core of the cable. The conductive terminal further includes a positioning wall for positioning the thin cable to reduce bending or dislocation of the thin cable caused by a force and thus minimize pulling of the core, thereby ensuring electrical connection between the piercing wall and the core of the thin cable. Thus, the cable connector of the present invention is well applicable to forming electrical connection with thin cables.

BRIEF DESCRIPTION OF THE DRAWINGS

The above and other aspects, features and other advantages of the present invention will be more clearly understood from the following detailed description taken in conjunction with the accompanying drawings, in which:

FIG. 4-1 is a cross-sectional diagram of the cable connector shown in FIG. 3 cut along line AA, wherein cables have not entered piercing blade portions.

FIG. 4-2 is a cross-sectional diagram of the cable connector shown in FIG. 3 cut along line AA, wherein the cables have entered the piercing blade portions.

FIG. 5-1 is a cross-sectional diagram of the cable connector shown in FIG. 3 cut along line BB, wherein positioning walls have a first shape.

FIG. 5-2 is a cross-sectional diagram of the cable connector shown in FIG. 3 cut along line BB, wherein the positioning walls have a second shape.

DETAILED DESCRIPTION OF THE PREFERRED EMBODIMENT

Figure 1:
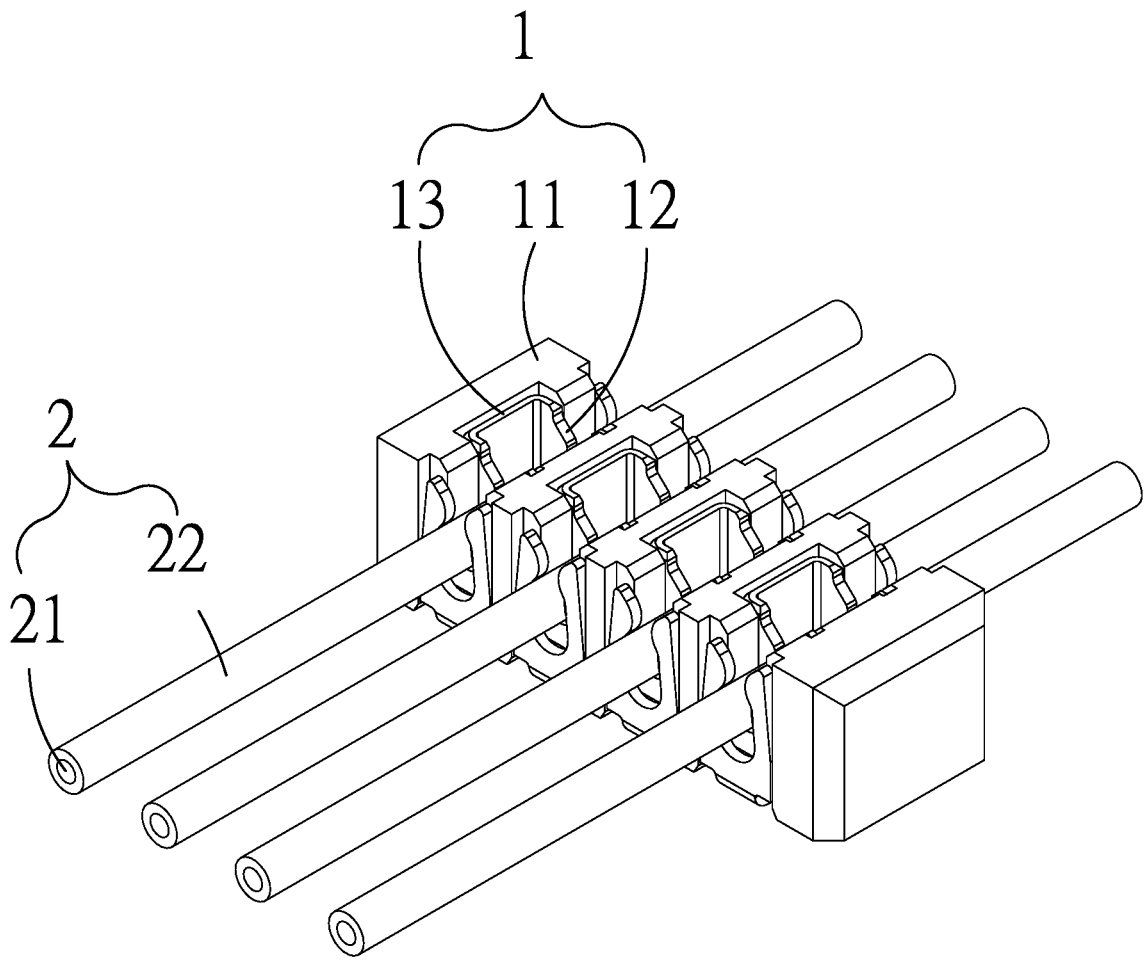
FIG. 1 is a schematic diagram showing a usage status of a cable connector according to the present invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

The present invention provides a cable connector, which is described hereinafter with reference to FIGS. 1 to 22.

Figure 2:
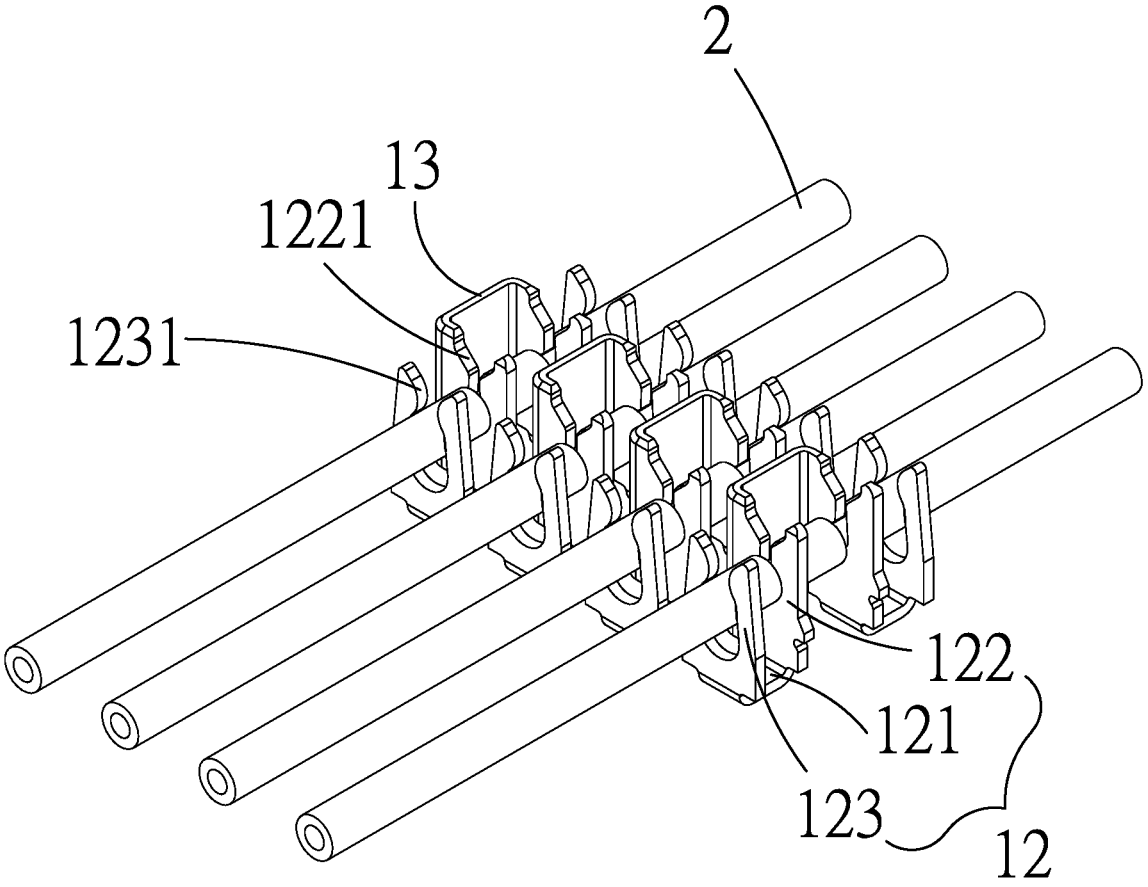
FIG. 2 is a schematic diagram showing the cable connector of FIG. 1 without an insulation base.
Figure 3:
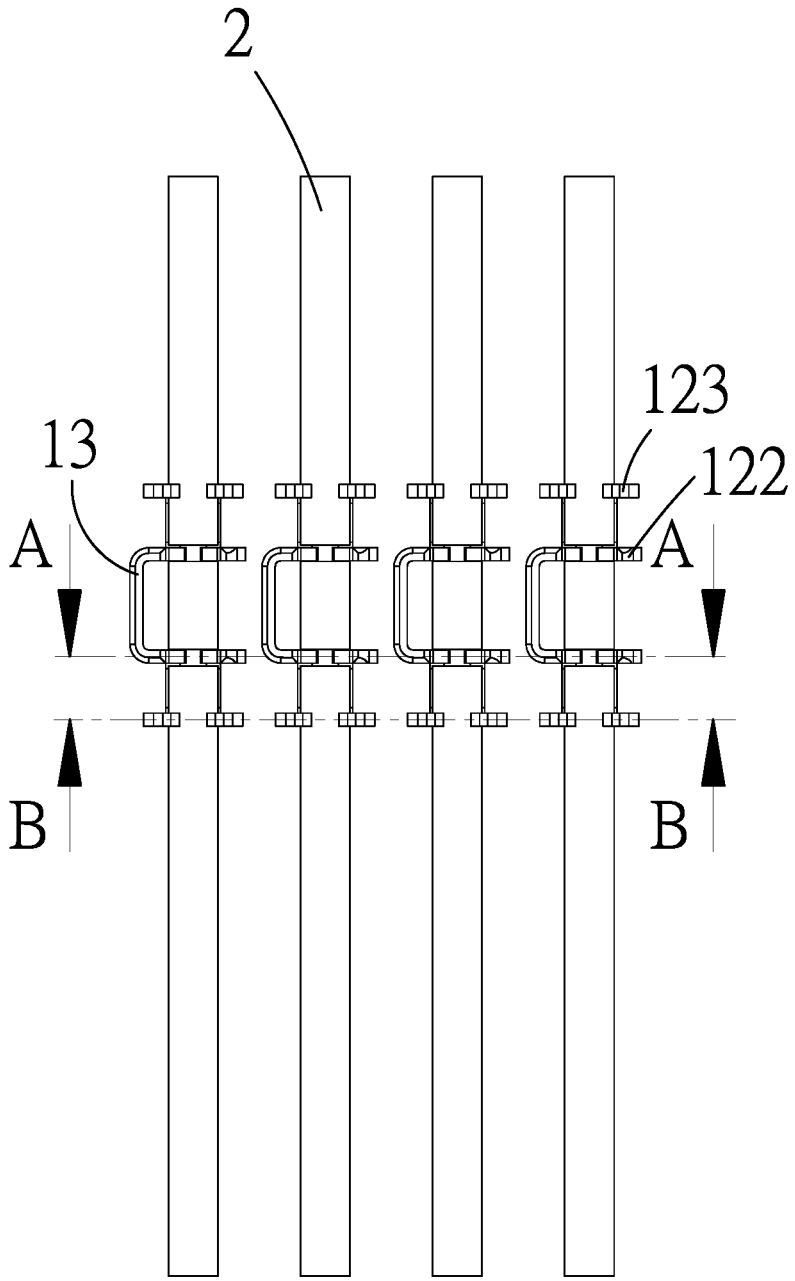
FIG. 3 is a top view of the cable connector shown in FIG. 1.

As shown in FIGS. 1 to 4, FIGS. 4-1 and 4-2, and FIGS. 5-1 and 5-2, the cable connector 1 according to the present invention is used for electrically connecting a core 21 of a cable 2. The cable 2 further includes an outer insulating sheath 22 (for example, rubber sheath) covering the core 21. The cable connector 1 includes an insulation base 11 and at least one conductive terminal 12. As shown in FIG. 2, the at least one conductive terminal 12 may include a plurality of conductive terminals 12. The conductive terminal 12 is embedded in the insulation base 11 and positioned by the insulation base 11. The conductive terminal 12 includes a terminal body 121, a piercing wall 122 and a positioning wall 123. The piercing wall 122 includes a piercing guiding portion 1221 and a piercing blade portion 1222. The positioning wall 123 includes a positioning guiding portion 1231 and a positioning hole 1232. As shown in FIG. 2, the positioning wall 123 and the piercing wall 122 are extended upwardly from a side of the terminal body 121, making the piercing guiding portion 1221 and the positioning guiding portion 1231 open towards a predetermined direction, such that the cable 2 can move in the predetermined direction to reach and touch the piercing guiding portion 1221 and the positioning guiding portion 1231 respectively which then guide the cable 2 to enter the piercing blade portion 1222 and the positioning hole 1232.

Preferably, the piercing wall 122 and the positioning wall 123 respectively have a U-shape cross section and are substantially parallel to each other, and the piercing blade portion 1222 faces directly the positioning hole 1232.

Figures 1, 4:
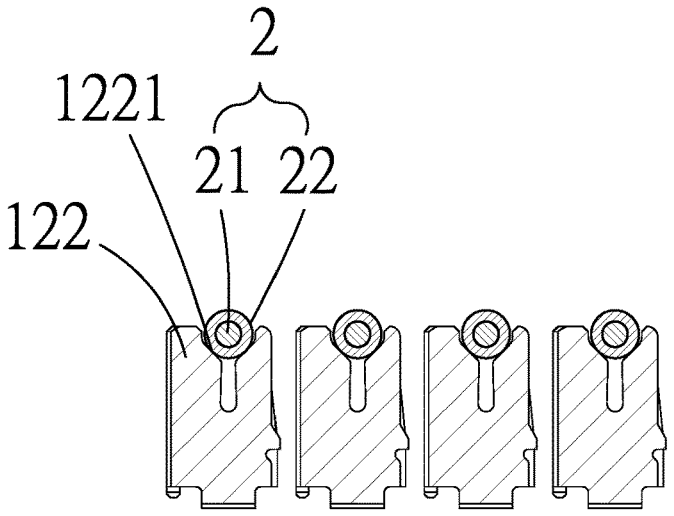
Figures 2, 4:
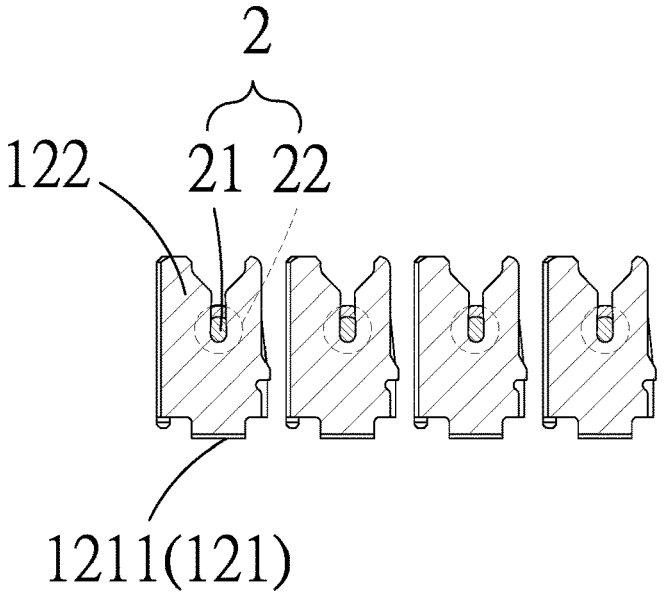

When the cable 2 is entering the piercing blade portion 1222, as shown in FIG. 4-1, it touches the piercing guiding portion 1221 and is thus guided to enter the piercing blade portion 1222. As shown in FIG. 4-2, when the cable 2 enters the piercing blade portion 1222, the piercing blade portion 1222 pierces the outer insulating sheath 22 of the cable 2 and is electrically connected to the core 21 of the cable 2.

Figures 1, 5:
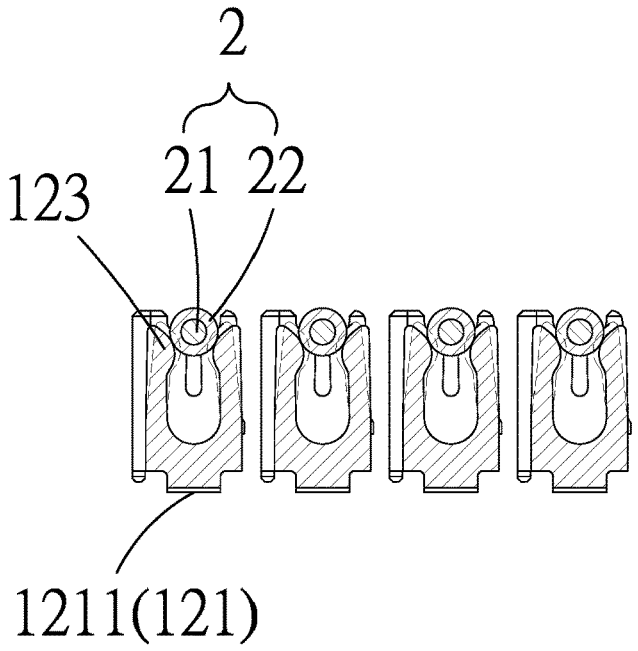
Figures 2, 5:
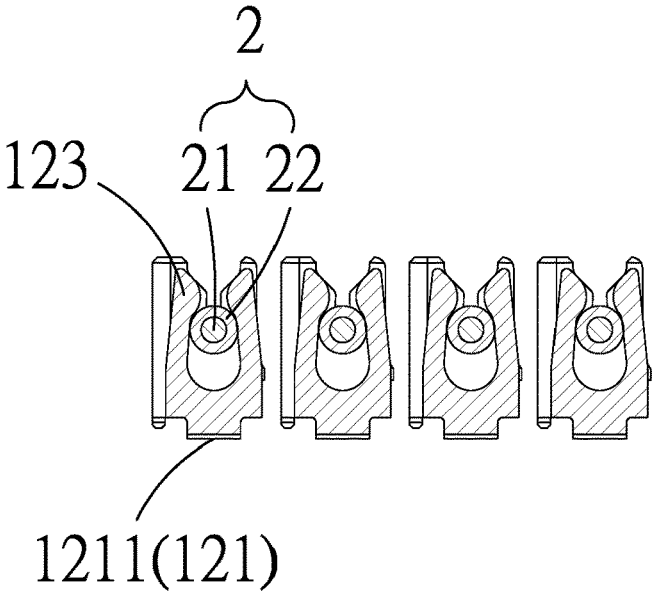

When the cable 2 is entering the positioning hole 1232, as shown in FIG. 5-1, it touches the positioning guiding portion 1231 and makes the positioning wall 123 become a first shape to allow the cable 2 to move along the positioning guiding portion 1231 and enter the positioning hole 1232. After the cable 2 enters the positioning hole 1232, as shown in FIG. 5-2, it leaves the positioning guiding portion 1231 and makes the positioning wall 123 become a second shape that restricts further movement of the cable 2, such that the cable 2 cannot move along the positioning guiding portion 1231 to leave the positioning hole 1232, but is kept within the positioning hole 1232, thereby having the cable 2 accommodated in and positioned by the positioning hole 1232.

The present invention is further described according to the following embodiments, wherein identical or similar parts may be assigned with same reference numerals, and identical or similar technical features may not be described repeatedly.

First Embodiment

Figure 9:
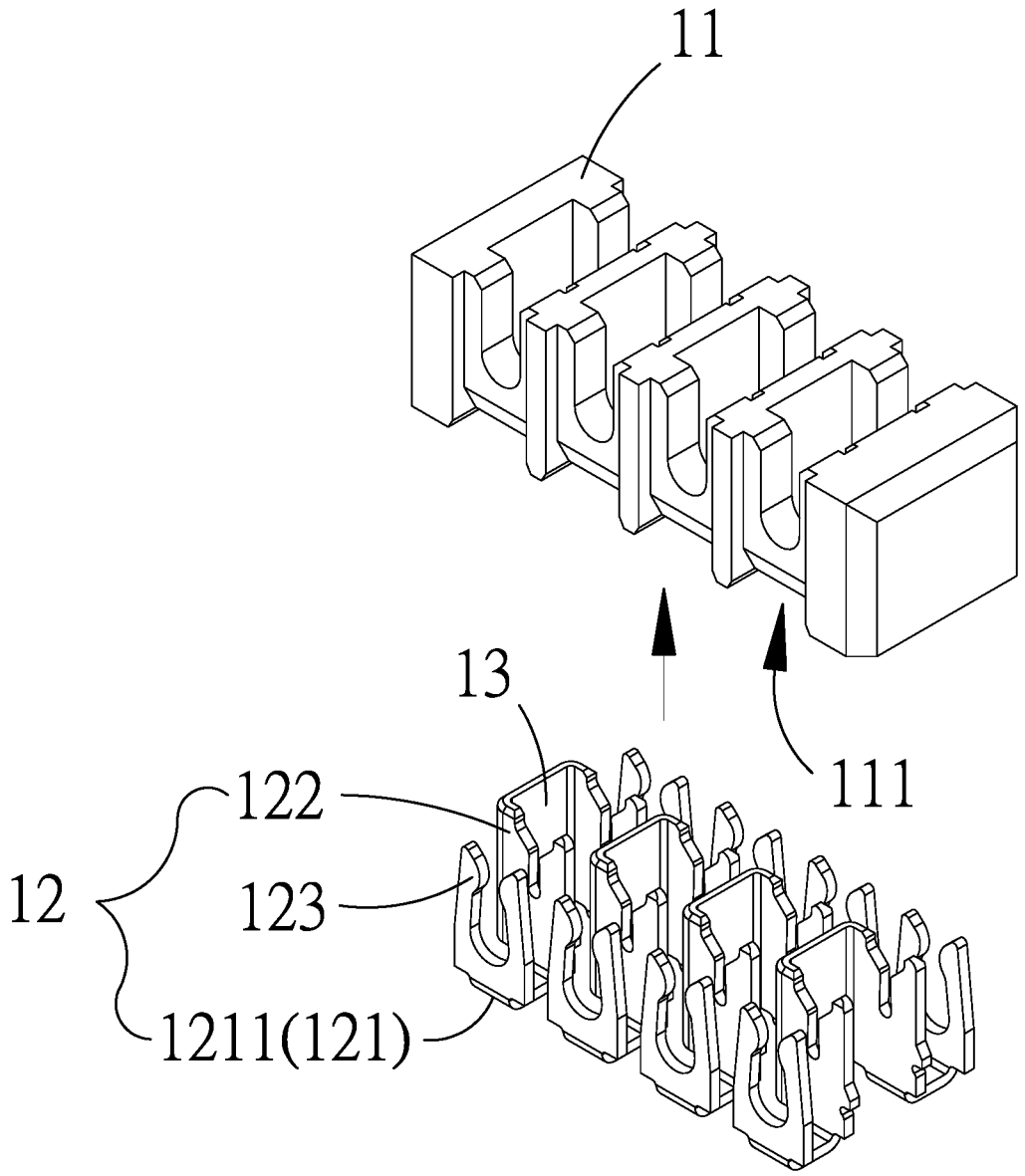
FIG. 9 is a breakdown diagram of the cable connector shown in FIG. 6.
Figure 10:
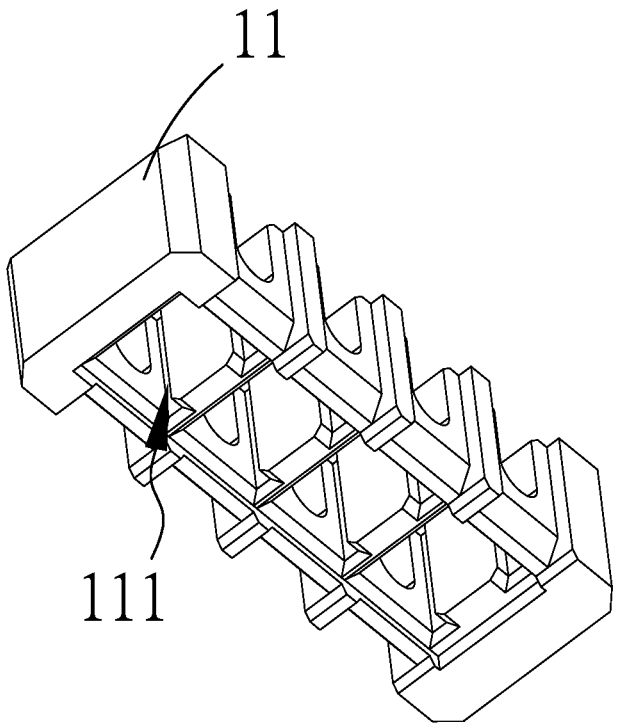
FIG. 10 is a schematic diagram of an insulation base of the cable connector shown in FIG. 6.

As shown in FIGS. 6 to 12, there is further formed an embedding opening 111 on a bottom side of the insulation base 11, allowing the conductive terminal 12 to be embedded into the insulation base 11 from the bottom side through the embedding opening 111. Thus, as shown in FIG. 9, the terminal body 121 is located on the same side as the embedding opening 111. Preferably, the terminal body 121 is connected to both shorter ends of the positioning wall 123 and piercing wall 122. The piercing wall 122 has a left-right symmetrical structure, which makes the piercing guiding portion 1221 of the piercing wall 122 able to guide the cable 2 to enter the piercing blade portion 1222 in a middle position, so as to allow the piercing blade portion 1222 to have both its right and left sides electrically connected to the core 21 of the cable 2, thereby enhancing electrical characteristics of the cable connector 1.

Moreover, the piercing wall 122 of the conductive terminal 12 further includes an engaging portion 1223 that is used to engage the insulation base 11 after the conductive terminal 12 is embedded in the insulation base 11 and thus to keep the conductive terminal 12 in position in order not to be separated from the insulation base 11, thereby ensuring reliability of the cable connector 1.

Figure 6:
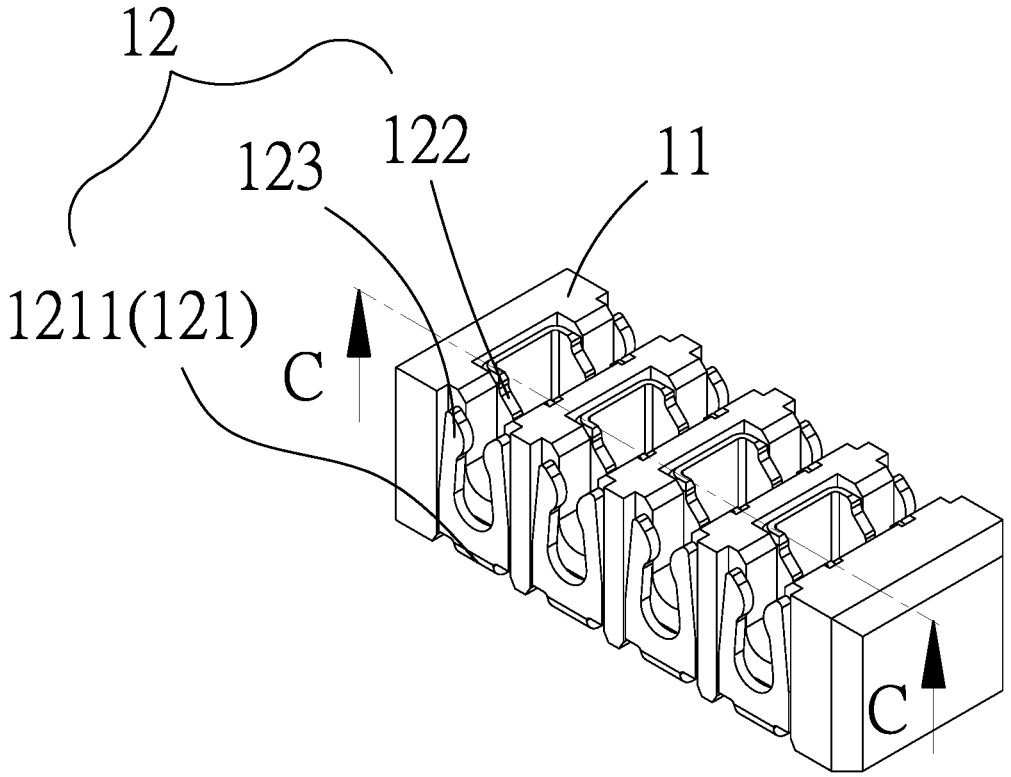
FIG. 6 is a schematic diagram showing a cable connector according to a first embodiment of the present invention.
Figure 7:
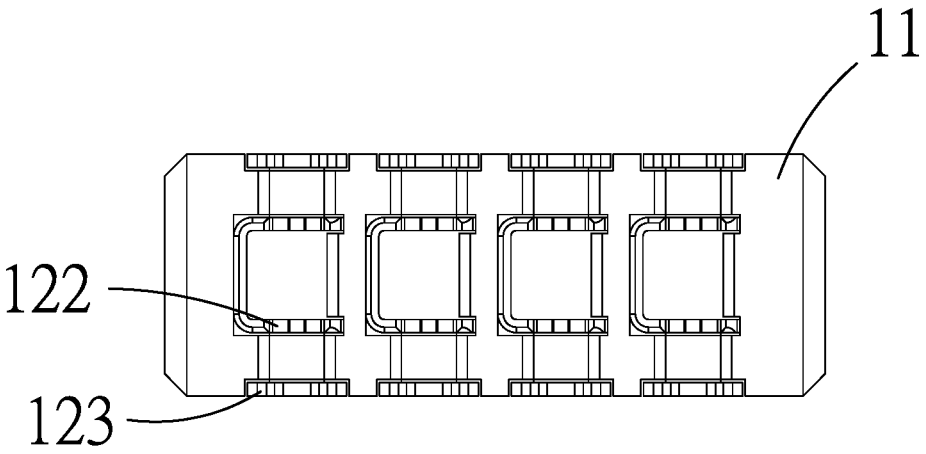
FIG. 7 is a top view of the cable connector shown in FIG. 6.
Figure 8:
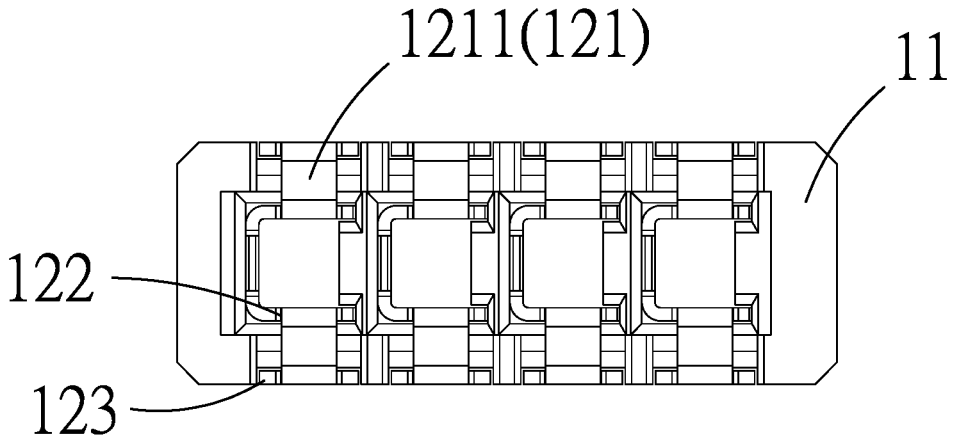
FIG. 8 is a bottom view of the cable connector shown in FIG. 6.
Figure 11:
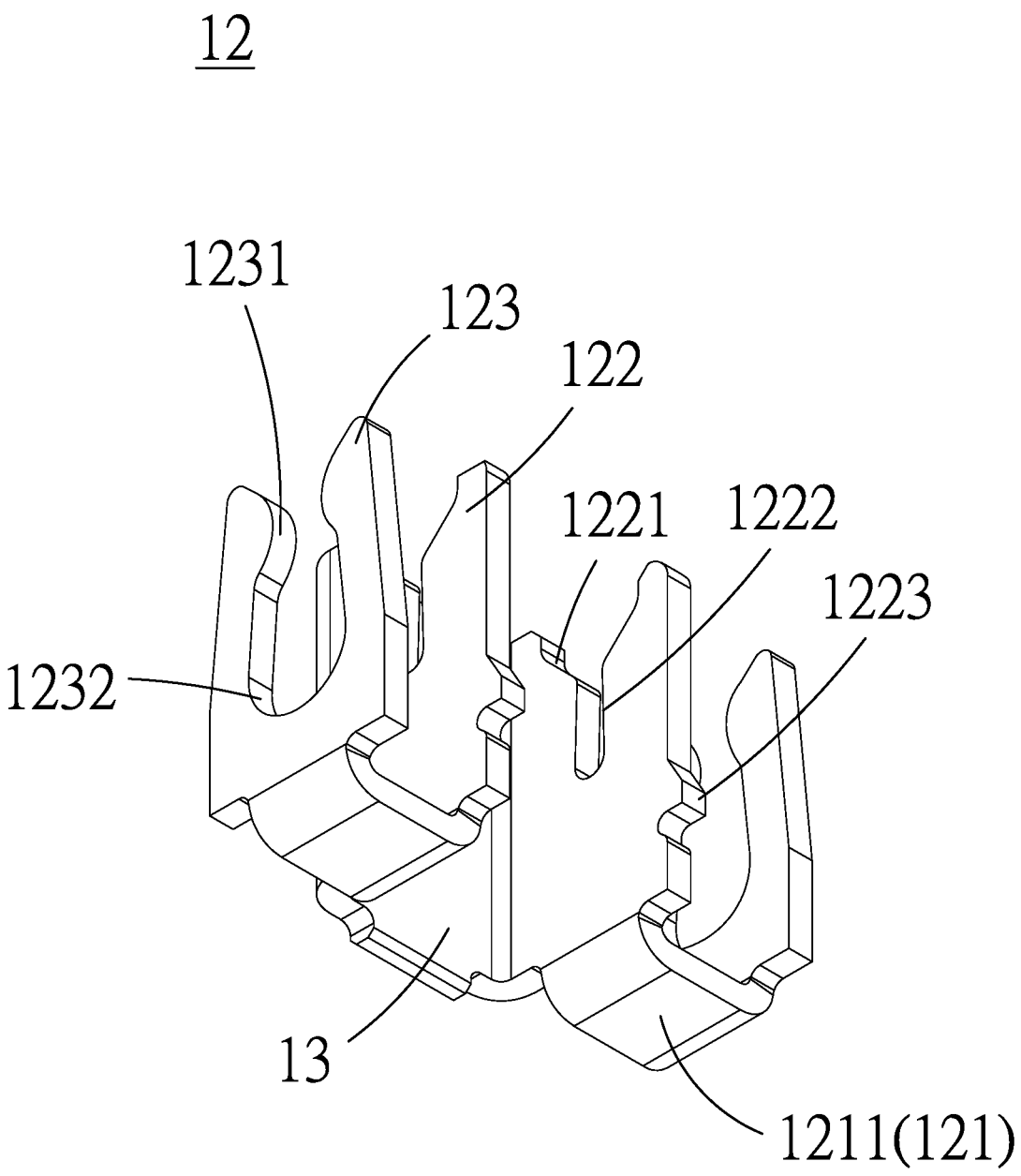
FIG. 11 is a schematic diagram of conductive terminals of the cable connector shown in FIG. 6.
Figure 12:
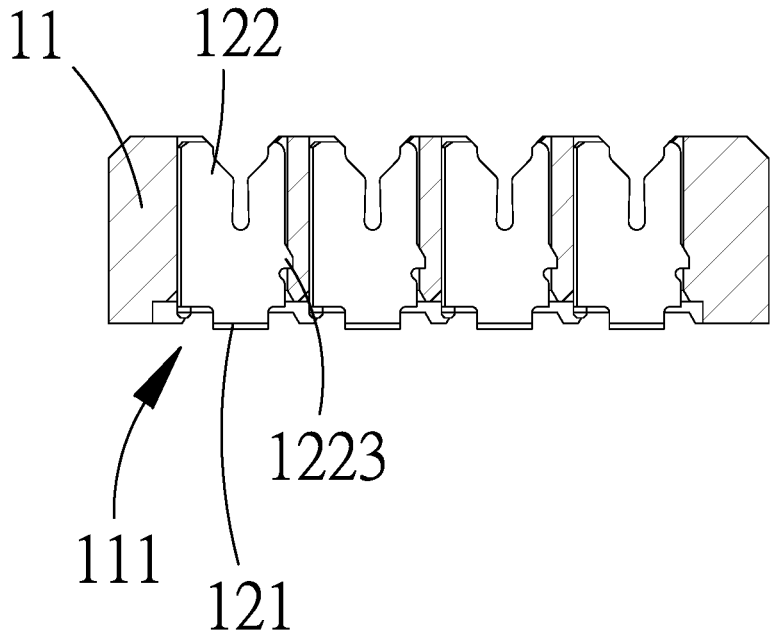
FIG. 12 is a cross-sectional diagram of the cable connector shown in FIG. 6 cut along line CC.
Figure 13:
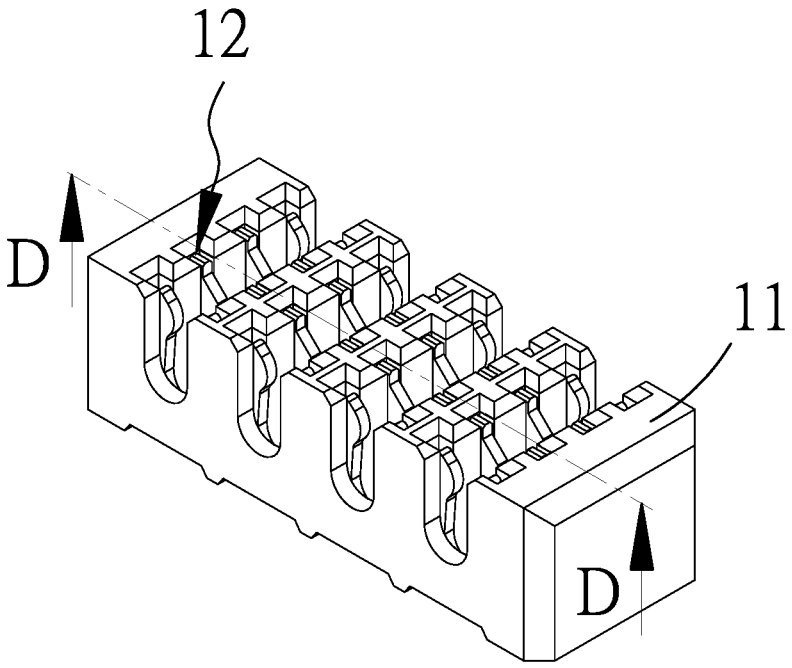
FIG. 13 is a schematic diagram showing a cable connector according to a second embodiment of the present invention.

There is further formed a bonding portion 1211 on a bottom side of the terminal body 121. As shown in FIG. 6, the bonding portion 1211 is exposed from the bottom side of the insulation base 11, and is used for bonding a carrier so as to achieve electrical connection between the cable connector of the present invention and the carrier. Referring to FIG. 11 showing two conductive terminals 12, the cable connector 1 further includes a coupling wall 13 for coupling longer sides of the piercing walls 122 of the two conductive terminals 12 together to make the two conductive terminals 12 become a single unit. This single unit can provide positioning and electrical connection for two positions on left and right sides of the cable 2 simultaneously, and the cable connector 1 is thus more flexible in use to meet different electrical characteristic requirements.

As shown in FIG. 9, the cable connector 1 further includes a plurality of coupling walls 13, each of which is used for coupling corresponding two conductive terminals 12 together, thereby forming a plurality of single units. Also as shown in FIG. 6, the plurality of single units are aligned in rows and embedded in the insulation base 11 at intervals.

Second Embodiment

Figure 14:
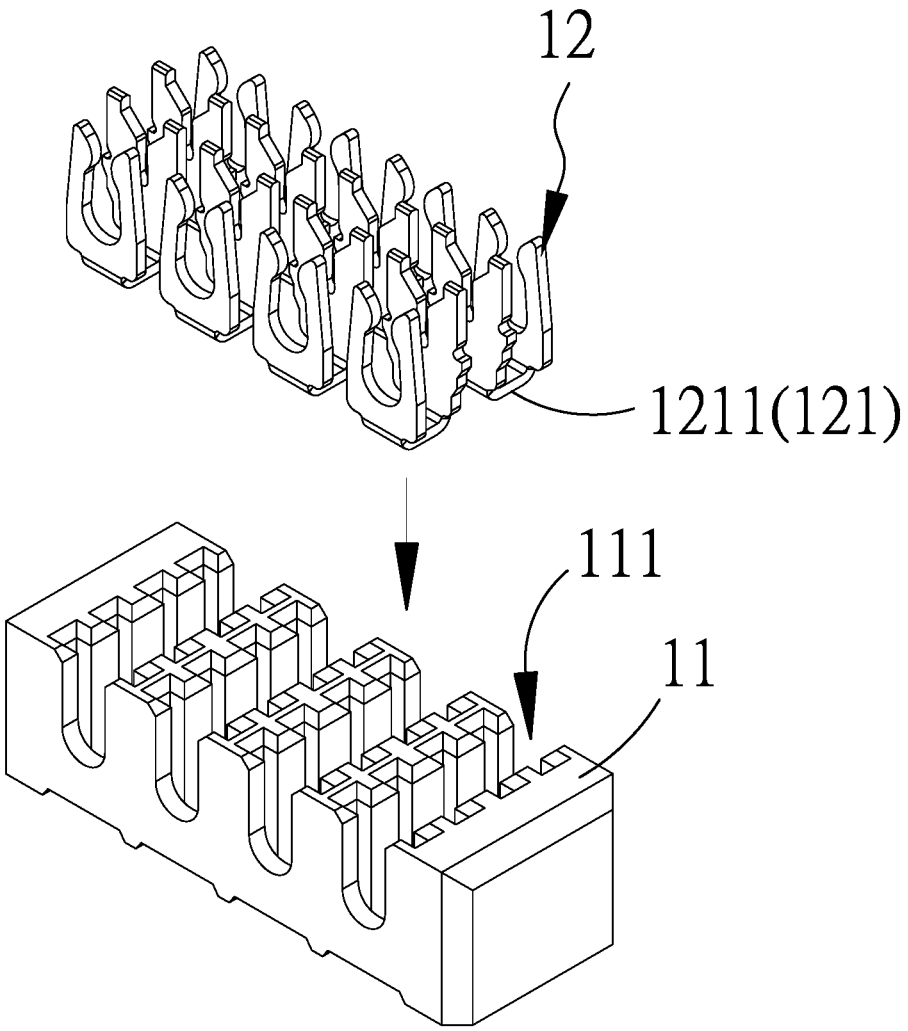
FIG. 14 is a breakdown diagram of the cable connector shown in FIG. 13.
Figure 15:
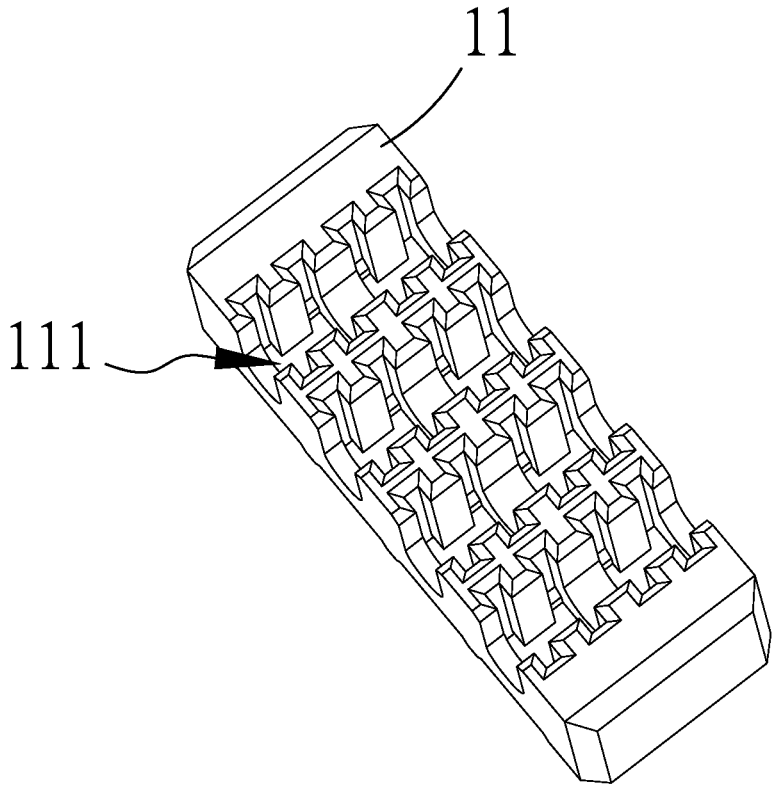
FIG. 15 is a schematic diagram of an insulation base of the cable connector shown in FIG. 13.
Figure 16:
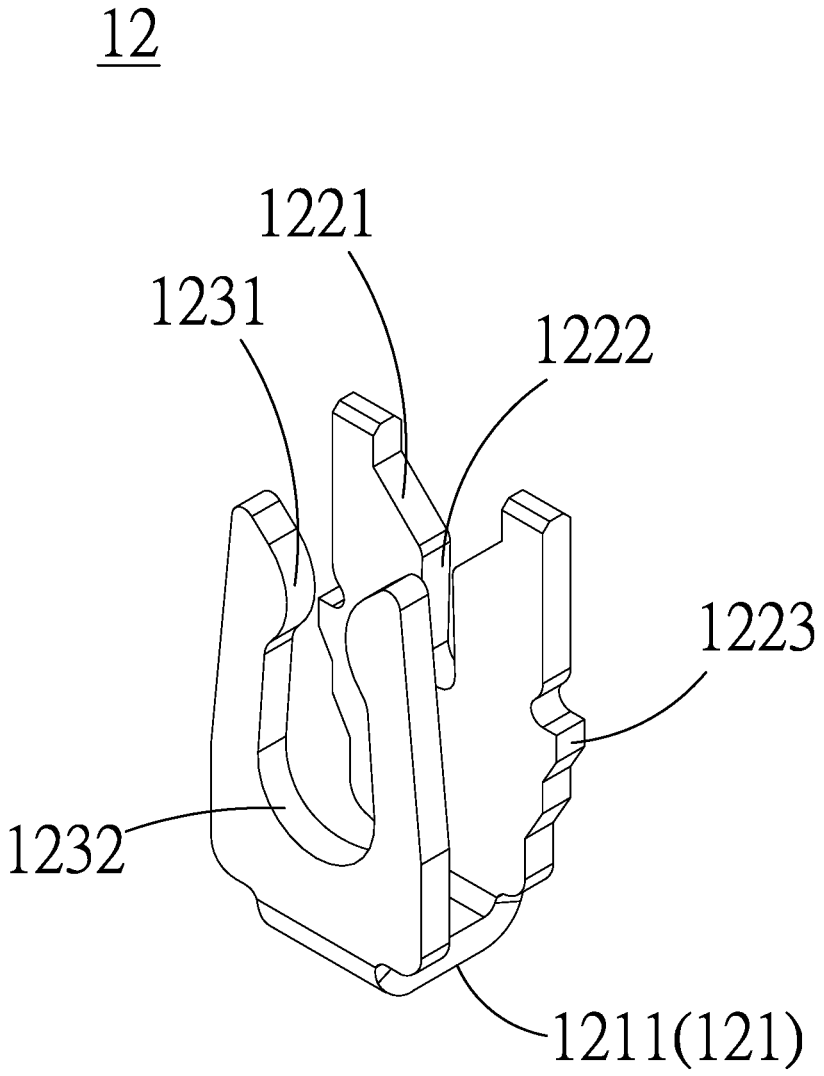
FIG. 16 is a schematic diagram of a conductive terminal of the cable connector shown in FIG. 13.
Figure 17:
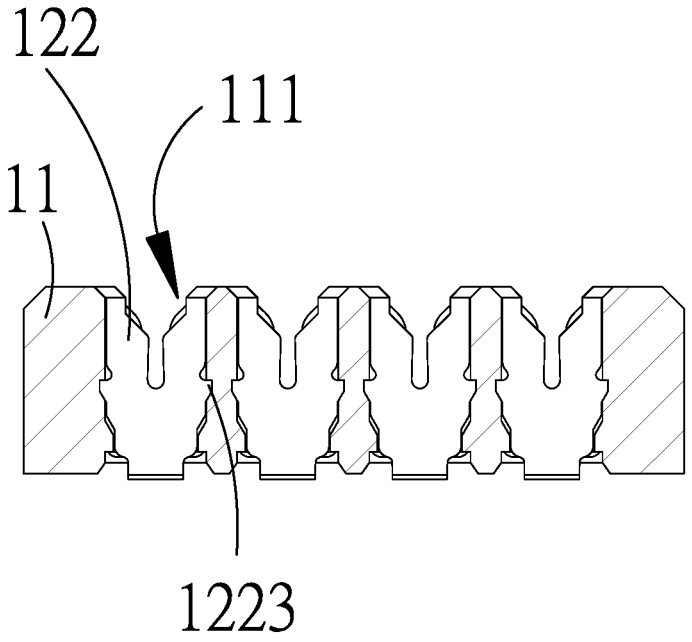
FIG. 17 is a cross-sectional diagram of the cable connector shown in FIG. 13 cut along line DD.

As shown in FIGS. 13 to 17, the embedding opening 111 is alternatively formed on a top side of the insulation base 11, allowing the conductive terminal 12 to be embedded into the insulation base 11 from the top side through the embedding opening 111. As shown in FIG. 14, the terminal body 121 can thus be positioned on a side of the insulation base 11 away from the embedding opening 111.

In this embodiment, there is no coupling wall 13 provided for the conductive terminal 12, which means that the conductive terminal 12 consists of the terminal body 121, the piercing wall 122 and the positioning wall 123. This also makes the cable connector more flexible in configuration to meet different electrical characteristic requirements.

Third Embodiment

Figure 21:
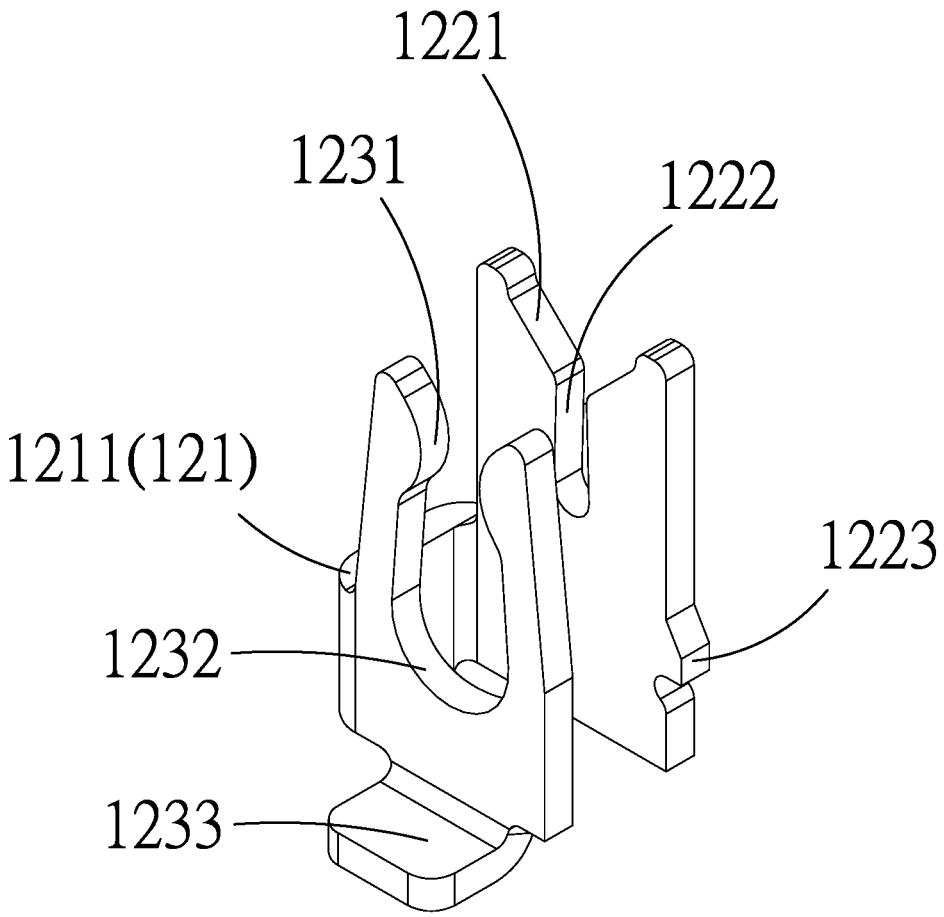
FIG. 21 is a schematic diagram of a conductive terminal of the cable connector shown in FIG. 18.
Figure 22:
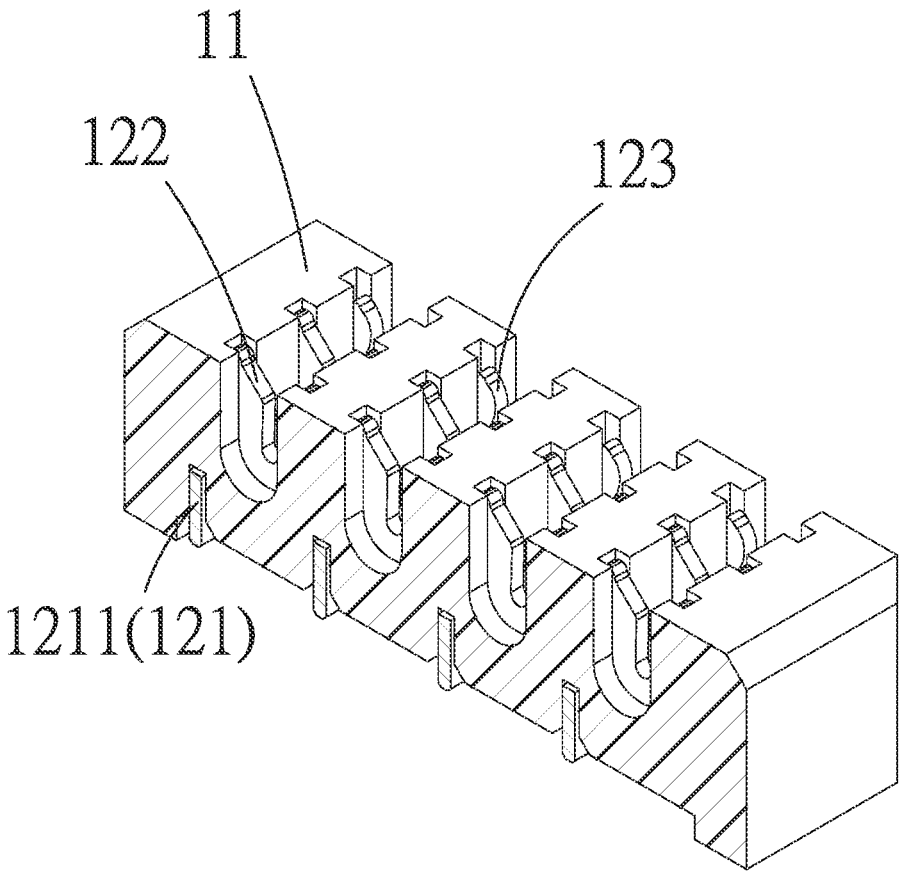
FIG. 22 is a cross-sectional diagram of the cable connector shown in FIG. 18 cut along line EE.

As shown in FIGS. 18 to 22, the embedding opening 111 is alternatively formed on the bottom side of the insulation base 11, allowing the conductive terminal 12 to be embedded into the insulation base 11 from the bottom side through the embedding opening 111. As shown in FIG. 21, the terminal body 121 of the conductive terminal 12 couples both longer sides of the positioning wall 123 and piercing wall 122 together.

Figure 18:
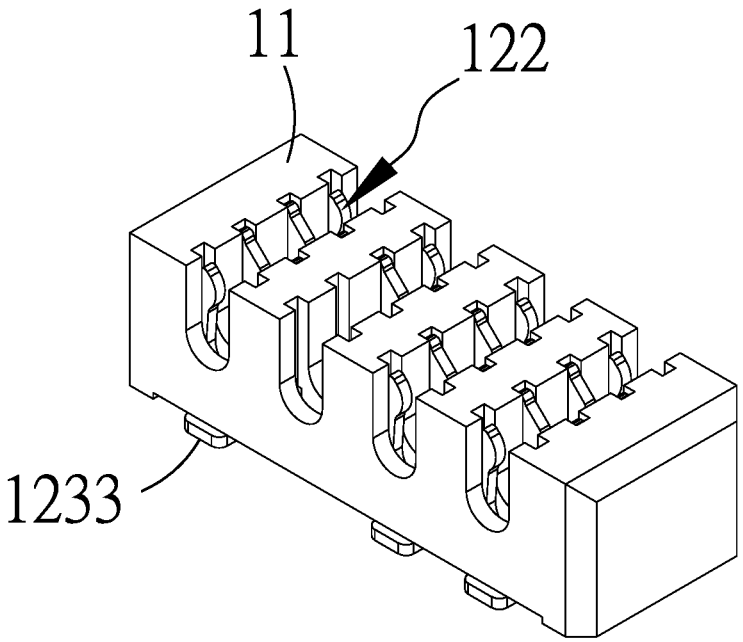
FIG. 18 is a schematic diagram showing a cable connector according to a third embodiment of the present invention.
Figure 19:
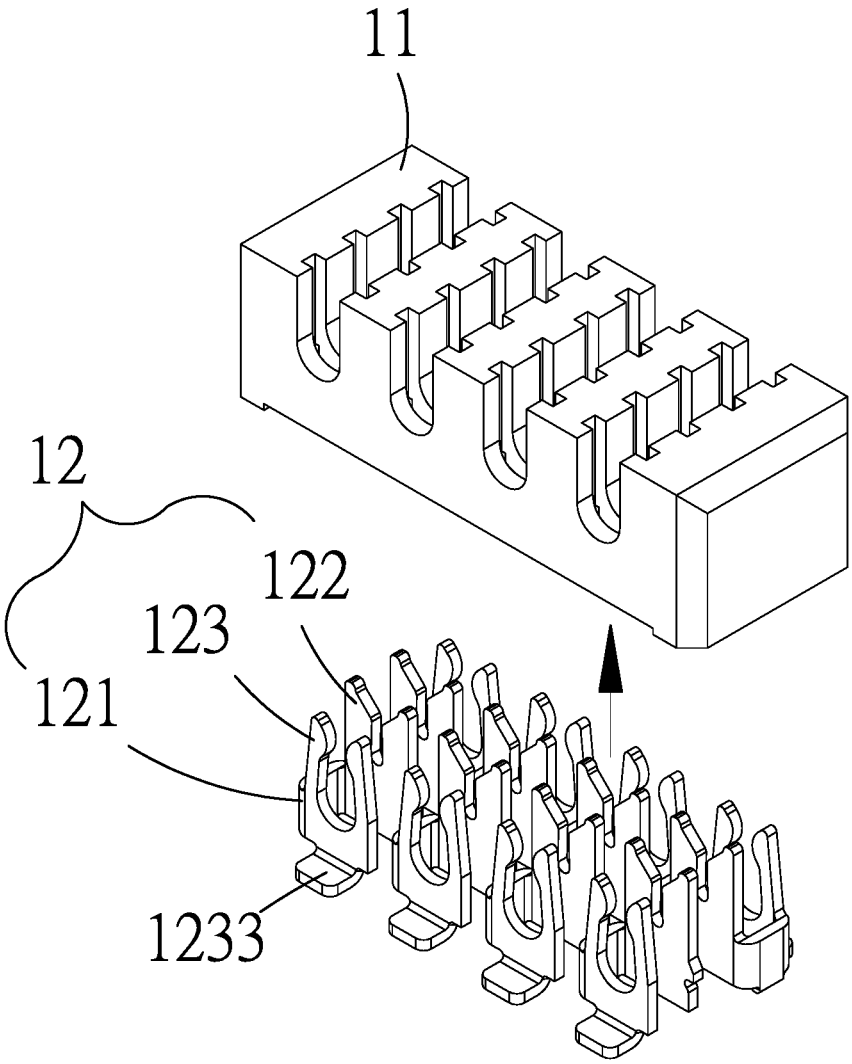
FIG. 19 is a breakdown diagram of the cable connector shown in FIG. 18.
Figure 20:
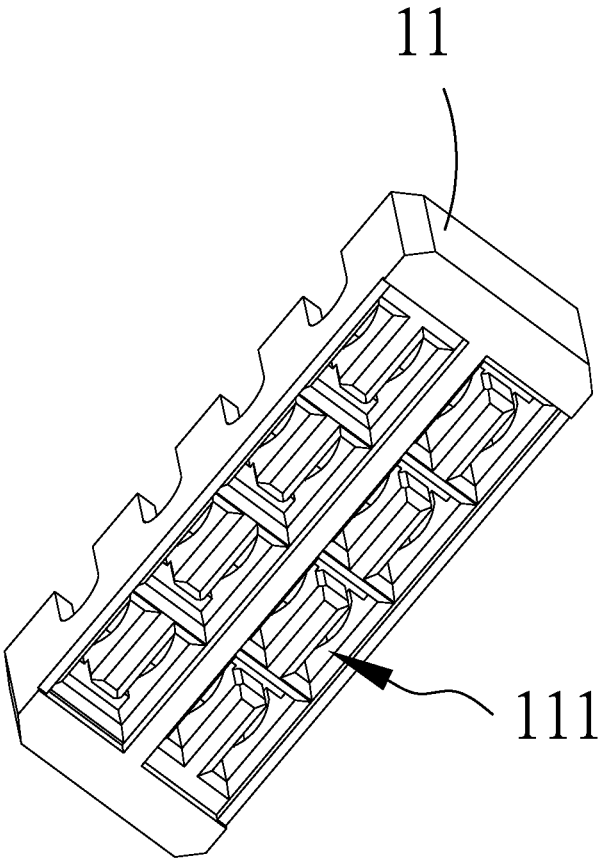
FIG. 20 is a schematic diagram of an insulation base of the cable connector shown in FIG. 18.

In this embodiment, as shown in FIG. 18, the positioning wall 123 is extended in a direction away from the piercing wall 122 to form a bonding portion 1233. The bonding portion 1233 is exposed from the bottom side of the insulation base 11, and is used for bonding a carrier so as to achieve electrical connection between the cable connector and the carrier.

In summary, a primary object of the present invention is to provide a cable connector. The cable connector includes a conductive terminal having a piercing wall. The piercing wall can pierce an outer insulating sheath of a thin cable to be electrically connected to an inner core of the cable. The conductive terminal further includes a positioning wall for positioning the thin cable to reduce bending or dislocation of the thin cable caused by a force and thus minimize pulling of the core, thereby ensuring electrical connection between the piercing wall and the core of the thin cable. Thus, the cable connector of the present invention is well applicable to forming electrical connection with thin cables.

The examples above are only illustrative to explain principles and effects of the invention, but not to limit the invention. It will be apparent to those skilled in the art that modifications and variations can be made without departing from the spirit and scope of the invention. Therefore, the protection range of the rights of the invention should be as defined by the appended claims.

What is claimed is:

1. A cable connector for forming electrical connection with a cable, the cable including a core and an outer insulating sheath covering the core, the cable connector including:

an insulation base having an embedding opening, an insulation guiding portion, and an insulation supporting portion, wherein the insulation guiding portion opens toward a predetermined direction to guide the cable to enter the insulation base in the predetermined direction; and at least one conductive terminal embedded in the insulation base to contact the insulation supporting portion through the embedding opening, the at least one conductive terminal including a terminal body, a piercing wall and a positioning wall, the piercing wall including a piercing guiding portion and a piercing blade portion, the positioning wall including a positioning guiding portion and a positioning hole, wherein the positioning wall and the piercing wall are extended from a side of the terminal body to make the piercing guiding portion and the positioning guiding portion open towards the predetermined direction, so as to allow the cable entering the insulation base to move in the predetermined direction and reach the piercing guiding portion and the positioning guiding portion where the cable is guided by the piercing guiding portion and the positioning guiding portion to enter the piercing blade portion and the positioning hole, wherein the outer insulating sheath is pierced by the piercing blade portion and the core is electrically connected to the piercing blade portion, and the cable is accommodated in and positioned by the positioning hole, wherein the insulation supporting portion provides support to the at least one conductive terminal to minimize a deformation of the at least one conductive terminal during a process that the outer insulating sheath is pierced by the piercing blade portion and the cable is positioned by the positioning hole.

2. The cable connector according to claim 1, wherein the embedding opening is provided on a top or bottom side of the insulation base, allowing the at least one conductive terminal to be embedded in the insulation base from the top or bottom side of the insulation base through the embedding opening, and the terminal body is coupled to shorter or longer sides of both the positioning wall and piercing wall.

3. The cable connector according to claim 1, wherein the terminal body is positioned on a side of the insulation base away from the embedding opening.

4. The cable connector according to claim 3, further including a plurality of coupling walls, and wherein the at least one conductive terminal includes a plurality of conductive terminals, and each of the coupling walls is coupled to two of the plurality of conductive terminals, so as to form a plurality of single units from the plurality of coupling walls and their corresponding coupled conductive terminals, wherein the plurality of single units are aligned in rows and embedded in the insulation base at intervals.

5. The cable connector according to claim 3, wherein the coupling wall is coupled to longer sides of the piercing walls.

6. The cable connector according to claim 1, further including at least one coupling wall, and wherein the at least one conductive terminal includes two conductive terminals forming a single unit by the coupling wall that is coupled to the piercing walls of the two conductive terminals.

7. The cable connector according to claim 1, wherein a bottom side of the terminal body is formed a bonding portion that is exposed from the bottom side of the insulation base, and is used for bonding a carrier so as to achieve electrical connection with the carrier.

8. The cable connector according to claim 1, wherein the positioning wall is extended in a direction away from the piercing wall to form a bonding portion exposed from the insulation base, wherein the bonding portion is for being bonded to a carrier to form electrical connection between the cable connector and the carrier.

9. The cable connector according to claim 1, wherein the piercing wall and the positioning wall respectively have a U-shape cross section.

10. The cable connector according to claim 1, wherein the at least one conductive terminal includes a plurality of conductive terminals that are aligned in rows and embedded in the insulation base at intervals.

11. The cable connector according to claim 1, wherein the positioning wall and the piercing wall are substantially parallel to each other, and the piercing blade portion faces directly the positioning hole.

12. The cable connector according to claim 1, wherein the piercing wall has a left-right symmetrical structure, allowing the piercing guiding portion to guide the cable to enter the piercing blade portion in a middle position, and making both left and right sides of the piercing blade portion electrically connected to the core.

13. The cable connector according to claim 1, wherein when the cable is entering the positioning hole, the cable touches the positioning guiding portion, making the positioning wall have a first shape to guide the cable to enter the positioning hole, and after the cable enters the positioning hole, the cable leaves the positioning guiding portion, making the positioning wall have a second shape to position the cable within the positioning hole.

14. The cable connector according to claim 1, wherein the piercing wall further includes an engaging portion that is used to engage the insulation base after the conductive terminal is embedded in the insulation base and thus to keep the conductive terminal in position.

* * * * *